US009390619B1

(12) United States Patent
Richardson et al.

(10) Patent No.: US 9,390,619 B1
(45) Date of Patent: Jul. 12, 2016

(54) ACCESSORY FOR CONTROLLING ACTIVATION OF A DEVICE

(71) Applicant: Smiths Detection-Watford Limited, Bushy (GB)

(72) Inventors: Steve Richardson, Brentwood (GB); Stephen Long, Tring (GB)

(73) Assignee: Smiths Detection-Watford Limited (GB)

( * ) Notice: Subject to any disclaimer, the term of this patent is extended or adjusted under 35 U.S.C. 154(b) by 109 days.

(21) Appl. No.: 14/204,169

(22) Filed: Mar. 11, 2014

Related U.S. Application Data

(60) Provisional application No. 61/777,537, filed on Mar. 12, 2013.

(51) Int. Cl.
*G08C 19/00* (2006.01)

(52) U.S. Cl.
CPC ..... *G08C 19/00* (2013.01)

(58) Field of Classification Search
CPC ..... G08C 19/00; G08C 17/02; G08C 2201/42–2201/91; G01D 21/00
See application file for complete search history.

(56) References Cited

U.S. PATENT DOCUMENTS 4,635,735 A * 1/1987 Crownover ..... E21B 49/08 175/42
6,647,328 B2 11/2003 Walker
6,829,476 B1 * 12/2004 Gelbein ..... G08B 5/228 340/7.1
6,990,335 B1 * 1/2006 Shamoon ..... G01D 21/00 455/410
8,671,747 B1 * 3/2014 Falkenborg ..... B60C 23/0494 73/146.8
2002/0072784 A1 * 6/2002 Sheppard, Jr. ..... A61B 1/041 607/60
2002/0077673 A1 * 6/2002 Penner ..... A61B 5/00 607/60
2003/0014091 A1 * 1/2003 Rastegar ..... A61N 1/08 607/61
2006/0068851 A1 * 3/2006 Ashman, Jr. ..... G06F 1/1626 455/566
2006/0105760 A1 * 5/2006 Shamoon ..... G01D 21/00 455/423
2006/0142819 A1 * 6/2006 Penner ..... A61B 5/00 607/60
2007/0106426 A1 * 5/2007 Ensworth ..... A01G 25/16 700/284
2007/0115902 A1 * 5/2007 Shamoon ..... G01D 21/00 370/338
2007/0155379 A1 * 7/2007 Shamoon ..... G01D 21/00 455/423
2007/0167179 A1 * 7/2007 Shamoon ..... G01D 21/00 455/466
2007/0270921 A1 * 11/2007 Strother ..... A61N 1/08 607/60

(Continued)

FOREIGN PATENT DOCUMENTS

WO 2013108071 7/2013

*Primary Examiner* — Hai Phan
*Assistant Examiner* — Orlando Bousono
(74) *Attorney, Agent, or Firm* — Advent, LLP

(57) ABSTRACT

An accessory for a device includes an actuator that is configured to be activated to operate a switch on the device when the accessory is physically engaged with the device. The switch is operable to cause the device to switch between on and off modes in which the device is configured to function. The off mode is a mode in which the device consumes less energy than when in the on mode. A controller is communicatively coupled with the actuator and is configured to activate the actuator to operate the switch when power is applied to the actuator.

20 Claims, 6 Drawing Sheets

(56) References Cited

U.S. PATENT DOCUMENTS

2008/0103553 A1* 5/2008 Penner ..... A61B 5/00 607/60
2008/0156406 A1* 7/2008 Breed ..... B60C 23/041 152/415
2008/0184519 A1* 8/2008 Cunningham ..... A47L 5/38 15/319
2008/0221555 A1* 9/2008 Sheppard ..... A61B 1/041 604/890.1
2008/0222836 A1* 9/2008 Cunningham ..... A47L 5/38 15/314
2008/0258931 A1* 10/2008 Christensen ..... G08C 17/02 340/12.22
2010/0161144 A1* 6/2010 Crist ..... A01G 25/16 700/284
2011/0212691 A1* 9/2011 Rott ..... H04B 1/3827 455/41.3
2012/0042833 A1* 2/2012 Gunn ..... A01K 7/06 119/408
2012/0094638 A1* 4/2012 Shamoon ..... G01D 21/00 455/414.1
2013/0140880 A1* 6/2013 Barefoot ..... B61H 13/02 303/28
2014/0196245 A1* 7/2014 Liter ..... A47L 9/2842 15/339

* cited by examiner

ACCESSORY FOR CONTROLLING ACTIVATION OF A DEVICE

CROSS-REFERENCE TO RELATED APPLICATIONS

The present application claims the benefit under 35 U.S.C. §119(e) of U.S. Provisional Application Ser. No. 61/777,537, filed Mar. 12, 2013, and titled "ACCESSORY FOR CONTROLLING ACTIVATION OF A DEVICE," which is herein incorporated by reference in its entirety.

BACKGROUND

Devices include an on/off switch which usually requires manual operation by a user. It is particularly important to control the on/off mode of energy constrained devices. It is also desirable to be able to operate the on/off switch when the device is located in an environment hostile to the user, or when the device is far from or not easily accessible for the user.

SUMMARY

An accessory for a device includes an actuator that is configured to be activated to operate a switch on the device when the accessory is physically engaged with the device. The switch is operable to cause the device to switch between on and off modes in which the device is configured to function. The off mode is a mode in which the device consumes less energy than when in the on mode. A controller is communicatively coupled with the actuator and is configured to activate the actuator to operate the switch when power is applied to the actuator.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

The detailed description is described with reference to the accompanying figures. The use of the same reference number in different instances in the description and the figures may indicate similar or identical items.

DETAILED DESCRIPTION

Embodiments of the disclosure relate to an accessory which can be mounted on a device having an on/off switch, the accessory comprising an actuator which can be activated by a controller in order to switch on the device when power is applied to the actuator. This may enable less energy to be used for operation of the device, which is particularly advantageous in the case of an energy constrained device. This may also enable remote activation of the device, which is particularly advantageous when the device is located in an environment hostile to a user, or when the device is far from or not easily accessible for the user. The actuator may be retrofitted on already existing devices, without any modification or recertification of the devices on which the accessory may be mounted.

The controller may be configured to activate the actuator to operate the switch to cause the device to switch to the off mode when power is applied to the controller. Alternatively or additionally, the controller may be configured to activate the actuator to operate the switch to cause the device to switch to the off mode when power is not applied to the controller. This may further reduce the energy to be used by the device, which is particularly advantageous in the case of an energy constrained device.

The accessory may comprise a cap configured to be mounted to an inlet of the device and having an open condition providing access to the inlet and a closed condition inhibiting access to the inlet. The cap may be configured to be actuated by the actuator to switch on the device in its open condition. This may further reduce the energy to be used by the device, which is particularly advantageous in the case of an energy constrained device.

Figure 1:
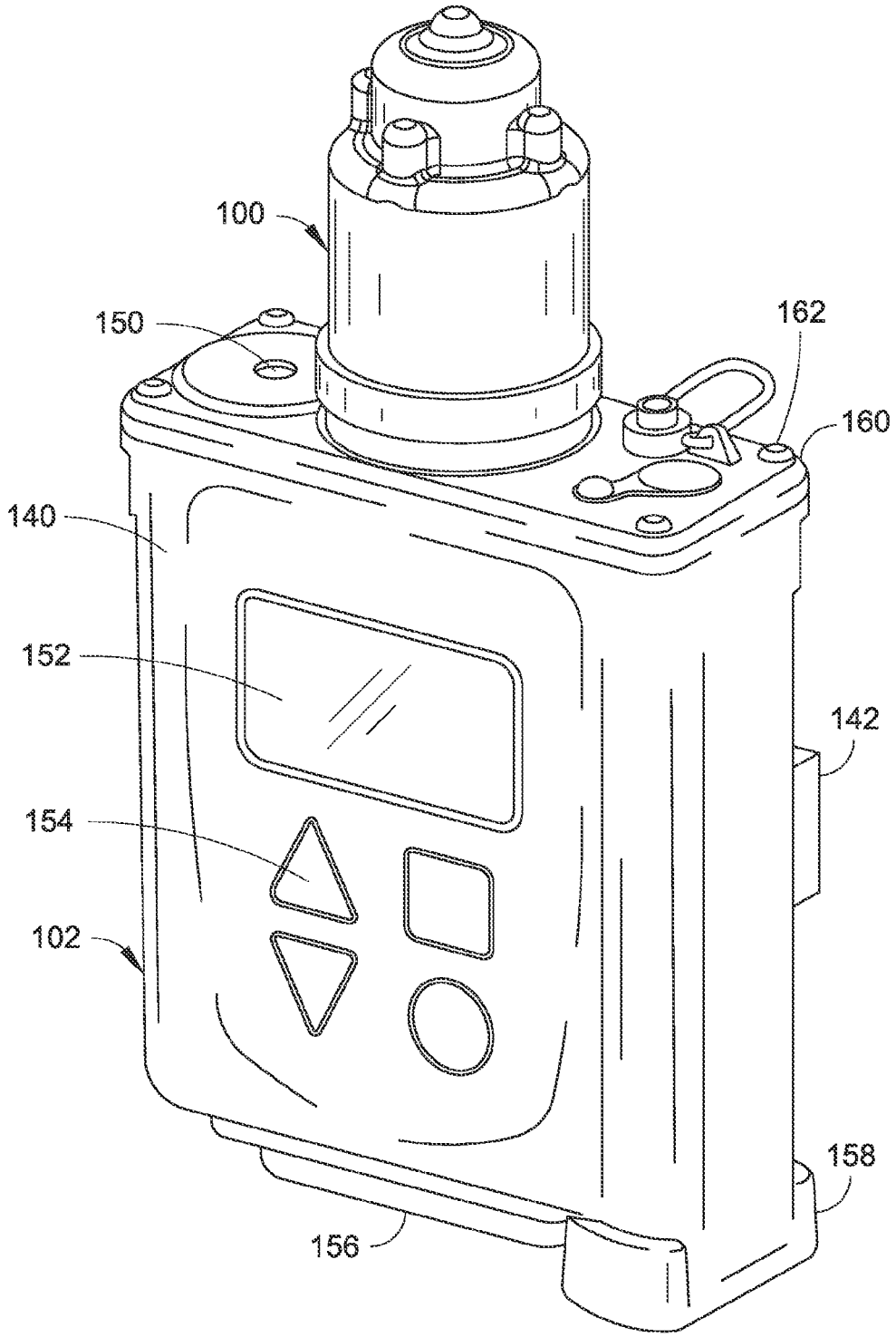
FIG. 1 is a perspective elevation view that illustrates an embodiment of a system comprising a device and an example accessory in accordance with the present disclosure.
Figure 2A:
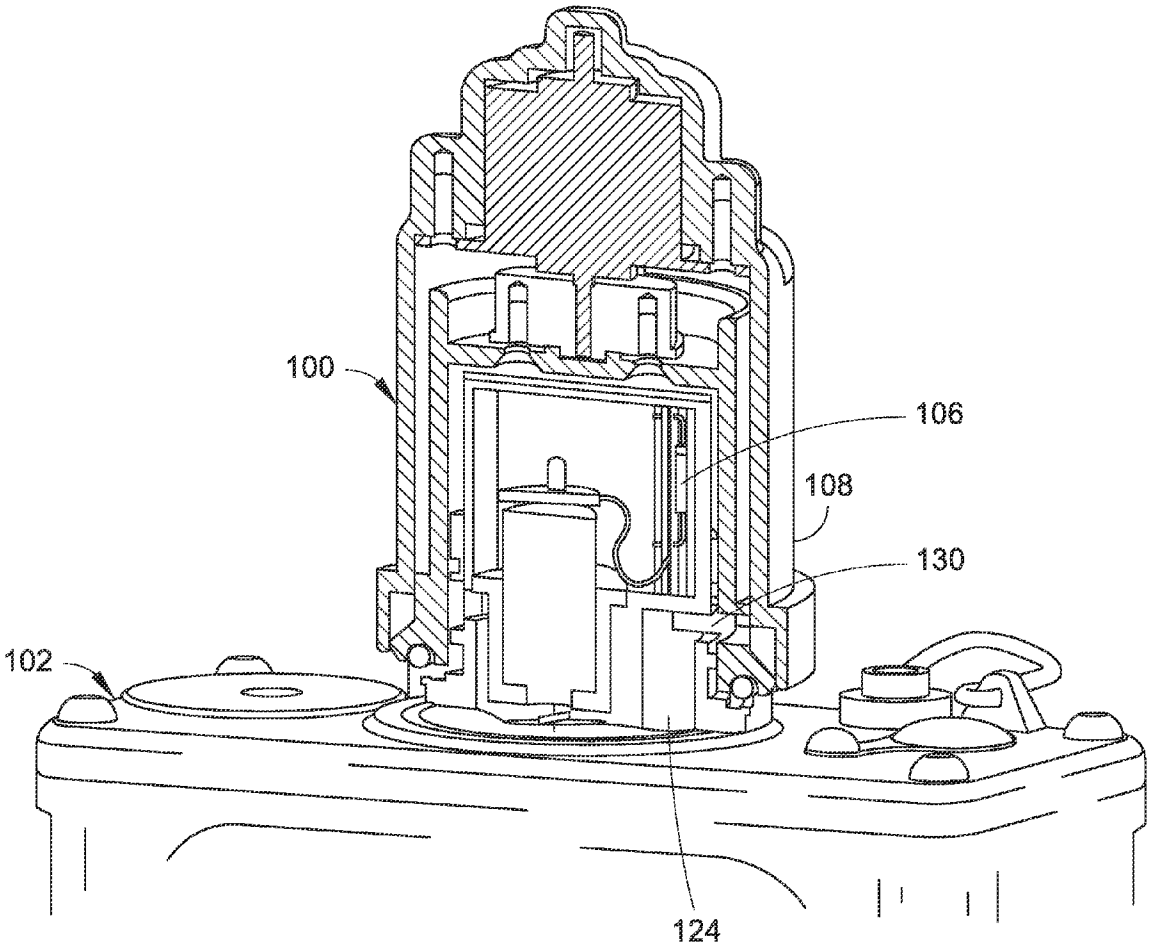
FIG. 2A is a cross-sectional view that illustrates an example embodiment of a system in accordance with the present disclosure.
Figure 2B:
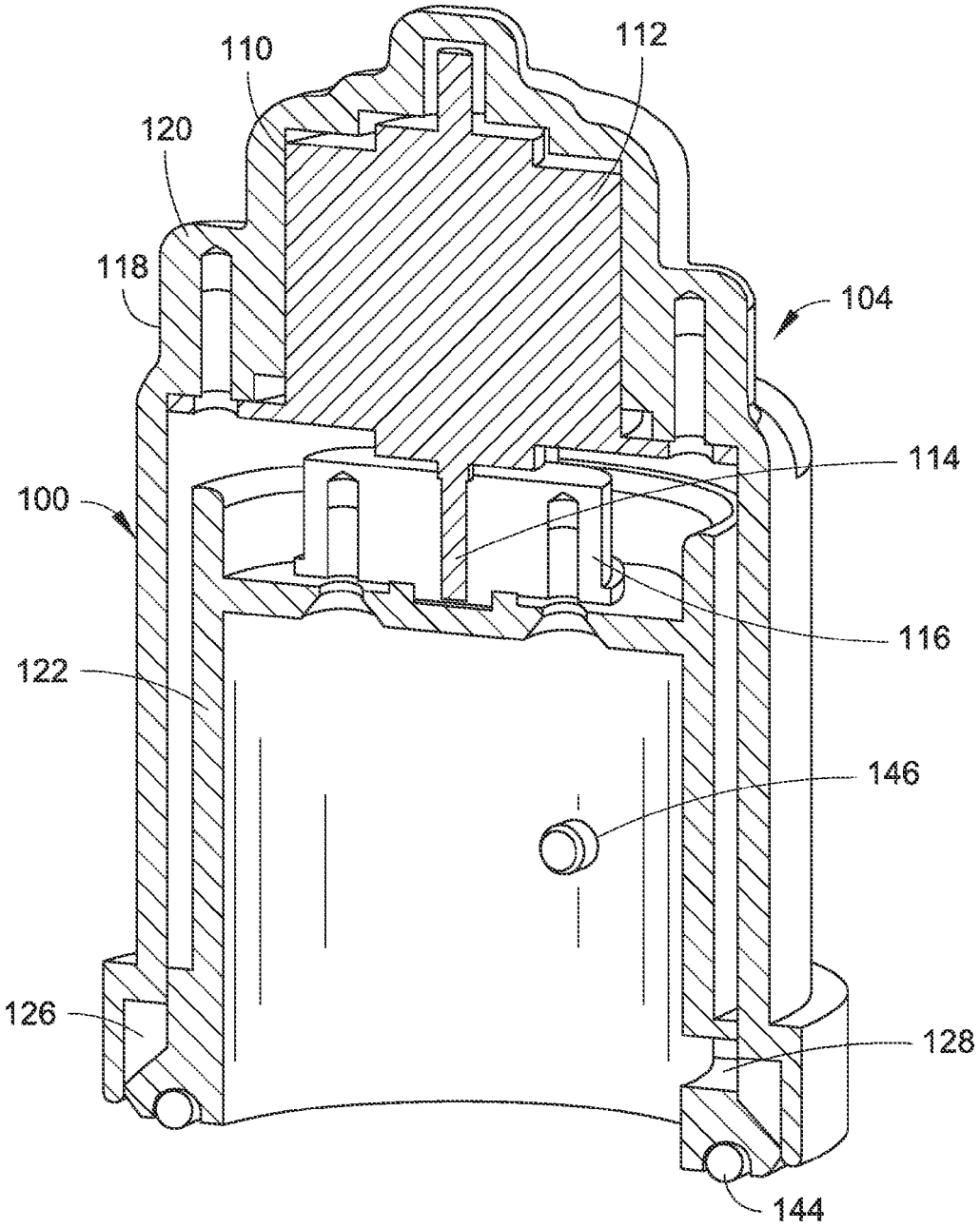
FIG. 2B is a cross-sectional view that illustrates an example embodiment of an accessory in accordance with the present disclosure.

FIG. 1 is a perspective elevation view that illustrates an embodiment of a system comprising a device and an example accessory mounted on the device. FIG. 2A is a cross-sectional view that illustrates the accessory mounted on the device. FIG. 2B is a cross-sectional view that illustrates an example embodiment of an accessory without the device. FIG. 1, FIG. 2A and FIG. 2B illustrate the example accessory 100 for a device 102. The accessory 100 comprises an actuator 104 configured to be activated to operate a switch 106 on the device 102 when the accessory 100 is physically engaged with the device 102 (as shown in FIG. 2A). Activation of the actuator 104 causes the device 102 to switch between an off mode and an on mode. An activation mechanism 108 may perform operation of the switch 106. The on mode of the device 102 may be a mode in which the device 102 is configured to function, and the off mode may be a mode in which the device 102 consumes less energy than when in the on mode. As shown in FIG. 2B, the accessory 100 also comprises a controller 110 communicatively coupled with the actuator 104. Communication between the controller 110 and the actuator 104 may be performed via wired connection or via wireless connection. As described in further detail below, the controller 110 may be configured to activate the actuator 104 to operate the switch 106 when power is applied to the actuator 104.

In the example illustrated by FIG. 1, FIG. 2A and FIG. 2B, the actuator 104 is further configured to operate without being electrically coupled with the device 102. "Electrically coupled" encompasses any type of electrical conductive link (such as involving a current or a voltage).

In the example illustrated by FIG. 1, FIG. 2A and FIG. 2B, the actuator 104 comprises a motorized drive mechanism. The motorized drive mechanism may comprise an electric motor such as a stepper motor 112 whose rotor 114 may have a thread forming a lead screw. The actuator 104 may also comprise a tapped nut 116 cooperating with the lead screw of the rotor 114.

In the example illustrated by FIG. 1, FIG. 2A and FIG. 2B, the accessory 100 comprises a main housing 118 which is configured to form a protective cap for the device for protection against an environment of the device (protection against e.g., rain and/or dust). In the example illustrated by FIG. 1, FIG. 2A and FIG. 2B, the main housing 118 comprises an outer sleeve 120 and an inner sleeve 122. The outer sleeve 120 may be movable relative to the inner sleeve 122. The outer sleeve 120 may be movable between a first position which defines an open condition of the cap which allows access to an inlet 124 of the device, and a second position which defines a closed condition of the cap which inhibits access to the inlet 124 of the device.

The outer sleeve 120 may comprise a peripheral seal 126 located in a part of the outer sleeve 120, and the inner sleeve 122 may comprise an aperture 128 which allows access to the inlet 124 of the device 102. The peripheral seal 126 may block the aperture 128 in the closed condition of the cap, and may allow access to the aperture 128 in the open condition of the cap.

In the example illustrated by FIG. 1, FIG. 2A and FIG. 2B, the accessory 100 may thus comprise the cap configured to be mounted to the inlet 124 of the device 102. Access to the inlet 124 may be allowed via the aperture 128. The accessory 100 may thus have a closed condition where the cap closes an opening 130 of the inlet 124 (e.g., the aperture 128 is closed by peripheral seal 126), and an open condition where the cap allows access to the inlet 124 via the aperture 128. The actuator 104 may thus be configured to cause the cap to change between the closed and open conditions, and, as described below in greater detail, the cap may further be configured to cause activation of the device 102 in the open condition. In the case where the device 102 is a test device, this may allow the device to run at least one analysis.

It is understood that other configurations are possible and e.g., the peripheral seal 126 may be located on the inner sleeve 122 and the aperture 128 on the outer sleeve 120.

In the example illustrated by FIG. 1, FIG. 2A and FIG. 2B, the stepper motor 112 and the rotor 114 are attached to the outer sleeve 120, and the tapped nut 116 is attached to the inner sleeve 122. It is understood that other configurations are possible and e.g., the stepper motor 112 may be attached to the inner sleeve 122 and the tapped nut 116 may be attached to the outer sleeve 120.

In the example illustrated by FIG. 1, FIG. 2A and FIG. 2B, the stepper motor 112 and the tapped nut 116 are attached to the outer sleeve 120 and the inner sleeve 122, respectively, using screws. Other fastening means are also possible, e.g., the stepper motor 112 and the tapped nut 116 may be glued to the outer sleeve 120 and/or the inner sleeve 122, respectively.

Figure 3A:
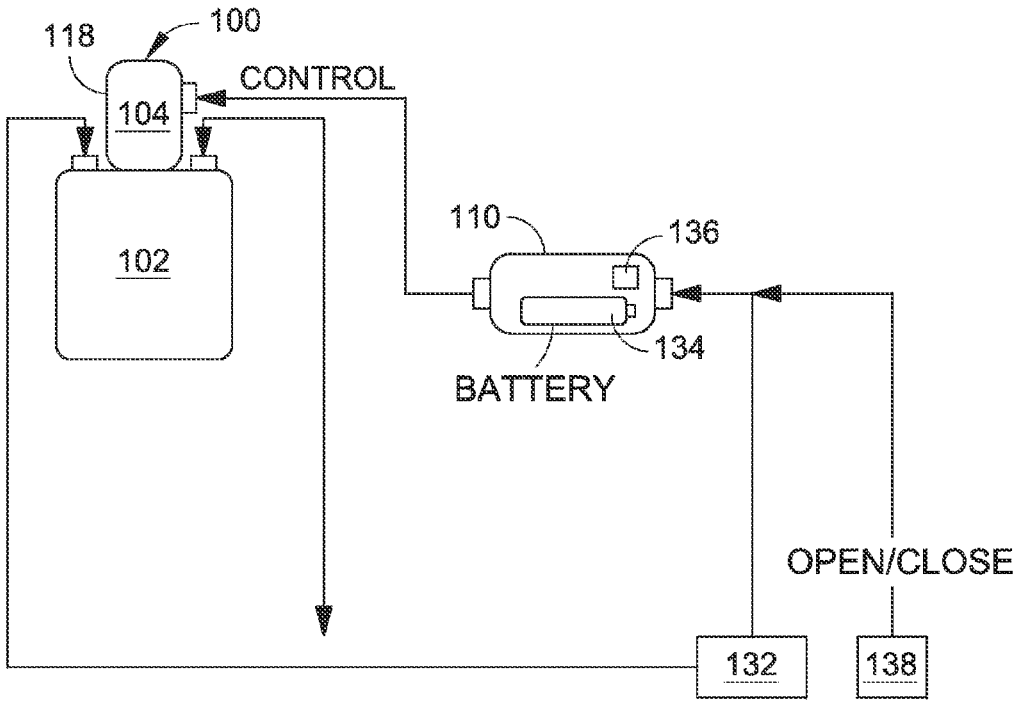
FIG. 3A is a diagrammatic view that illustrates an example of control of an accessory in accordance with the present disclosure by providing a control instruction to an actuator.
Figure 3B:
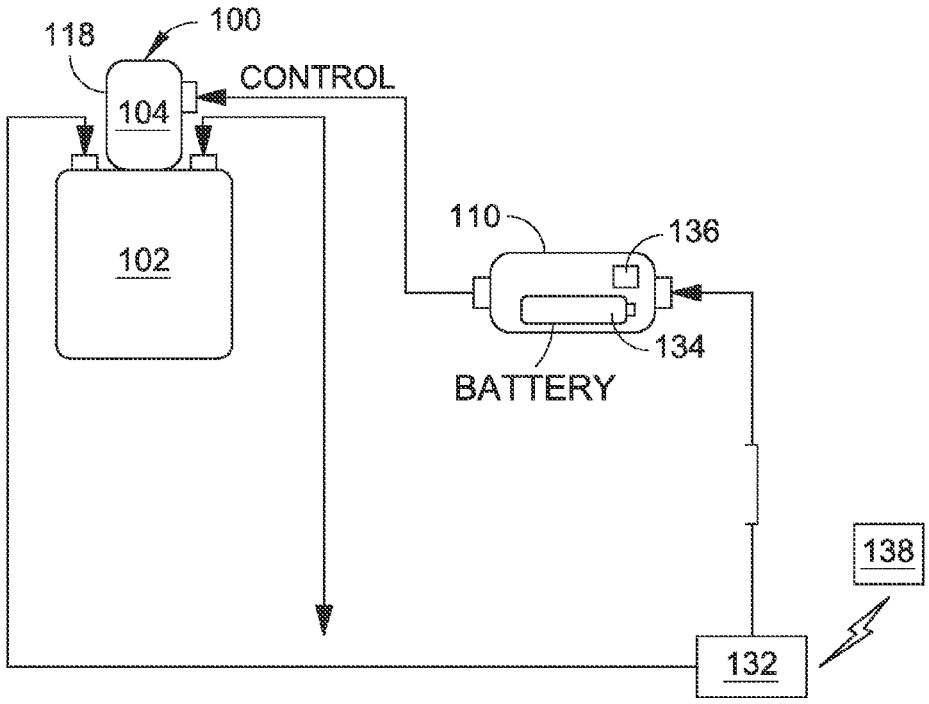
FIG. 3B is a diagrammatic view that illustrates an example of control of an accessory in accordance with the present disclosure by providing or removing power to a controller.

In the examples illustrated by FIG. 3A and FIG. 3B, the accessory 100 is configured to be powered by a power source 132 which may also be a power source to the device 102. Alternatively or additionally, the accessory 100 may be powered independently of the device 102. In the examples illustrated by FIG. 3A and FIG. 3B, the controller 110 comprises a battery 134 which is connected to the power source 132. In embodiments, the battery 134 may not be configured to operate continuously, but may be configured to provide a backup power supply in the event of a failure of the power source 132. The battery 134 may be rechargeable or non-rechargeable. The power source 132 may be a battery (e.g., a 28V power source) of a vehicle, e.g., on which the device may be mounted, or any other type of rechargeable or non-rechargeable battery. In other embodiments, the power source 132 may be any other type of power source. In embodiments, the accessory 100 may not be energy constrained. In other embodiments, the accessory 100 may be energy constrained, i.e., provided with a limited energy supply which can run out, such as a fuel cell or a battery. In embodiments, the controller 110 may be configured without the battery 134 and may only be connected to the power source 132. In other embodiments, the accessory 100 may be configured without the power source 132 and may thus only comprise a battery, e.g., a rechargeable or non rechargeable battery, such as the battery 134.

In the examples illustrated by FIG. 3A and FIG. 3B, the power source 132 is located in a module remote from the main housing 118.

In the examples illustrated by FIG. 3A and FIG. 3B, the controller 110 is configured to control activation of the actuator 104. In the examples illustrated by FIG. 3A and FIG. 3B, the controller 110 comprises a receiver 136 configured to receive a control instruction for controlling the operation of the stepper motor 112, from a remote controller 138.

In the example illustrated by FIG. 3A, the power source 132 provides power continuously to the controller 110, and the control instruction is provided by a separate signal from the remote controller 138. The controller 110 may thus be provided with an open/close instruction from the remote controller 138 (such as a voltage/current signal carrying the open/close instruction). In the example illustrated by FIG. 3A, the power supplied from the power source 132 to the controller 110 may be maintained until the cap is closed (e.g., the inlet 124 is closed). In the example illustrated by FIG. 3A, the battery 134 may provide backup power to the controller 110 in case of power failure of the power source 132. This may enable closing of the cap (e.g., closing of the inlet 124) in case of power failure of the power source 132 to the controller 110.

In the example illustrated by FIG. 3B, the control instruction is provided by the power source 132: for the open instruction received from the remote controller 138, the power source 132 may provide power to the controller 110, and for the close instruction received from the remote controller 138, the power source 132 may no longer supply power to the controller 110. Interruption of the power supply to the controller 110 from the power source 132 may thus be the close instruction. In the example illustrated by FIG. 3B, the battery 134 may provide power to the controller 110 when a close instruction is caused by interruption of power supply to the controller 110 from the power source 132. This may enable closing of the cap (e.g., closing of the inlet 124) in case of interruption of power supply to the controller 110 from the power source 132.

In the examples illustrated by FIG. 3A and FIG. 3B, the controller 110 in turn may send an open/close instruction to the actuator 104. The open/close instruction from the controller 110 may comprise a motor drive control signal in the form of a pulse voltage.

In the examples illustrated in FIG. 3A and FIG. 3B, the controller 110 is located remote from the main housing 118 of the accessory 100. In the examples illustrated in FIG. 3A and FIG. 3B, the protective cap thus does not contain any electronics. In other embodiments, the controller 110 may be configured to be part, at least partially, of the main housing 118. The controller 110 may be at least partially located inside or outside the outer sleeve 120. In other embodiments, the controller 110 may be configured to be part, at least partially, of the device. The controller 110 may be at least partially located inside or outside a housing 140 of the device 102. In other embodiments, the controller 110 may be configured to be part, at least partially, of a vehicle on which the device 102 may be mounted. The controller 110 may be at least partially located inside or outside the vehicle, e.g., inside the vehicle or on an external surface of the vehicle. In embodiments, the controller 110 may, at least partially, be part of a module which incorporates the device 102 and/or the protective cap. The module, in embodiments, may be located inside or outside of a vehicle on which the module may be mounted.

In other embodiments, the outer sleeve 120 or cap may be biased to automatically return in the closed position (e.g., using a spring bias) when the actuator 104 is not activated. This may enable closing of outer sleeve 120 or cap (e.g., closing of the inlet 124) in case of interruption of power supply to the controller 110, in response to a close instruction or a failure of the power source and/or the backup battery, without the need for a backup battery in the controller or any power source in the accessory.

The controller 110 may be provided by any appropriate controller, for example by analogue and/or digital logic, field programmable gate arrays, FPGA, application specific integrated circuits, ASIC, a digital signal processor, DSP, or by software loaded into a programmable general purpose processor.

In the example illustrated in FIG. 1, a system comprises a device 102 and an accessory 100. In the example illustrated in FIG. 1, the system comprises a mounting bracket 142 configured to enable the mounting of the device 102 on a vehicle. The vehicle may be a land vehicle, a water vehicle or an aircraft. The system may also be configured to be portable, and in embodiments may be hand-held, by a user.

In the example illustrated by FIG. 1, FIG. 2A and FIG. 2B, the accessory 100 comprises a seal 144 located at an interface part of the main housing 118 of the accessory 100. This may enable providing water-tight sealing (e.g., Ingress Protection Rating (IP) 65 or greater) between the accessory 100 and the device 102 of the system.

As already explained, in the example illustrated by FIG. 1, FIG. 2A and FIG. 2B, the accessory 100 is configured to form a protective cap for the device 102. The accessory 100 in accordance with the disclosure may be configured to replace existing caps already mounted on existing devices. The accessory 100 in accordance with the disclosure may take advantage of mounting configurations already in place on existing devices, such as e.g., bayonet grooves.

In the example illustrated in FIGS. 2A and 2B, the accessory 100 comprises a fastening mechanism 146 configured to be mounted on an existing device 102 without modification of the device 102. This may have the advantage that the accessory 100 may be retrofitted on already existing devices, such as test devices, without any modification or recertification of the devices on which the accessory 100 is mounted. In the example illustrated in FIG. 2B, the fastening mechanism 146 comprises a pin which cooperates with an existing groove of a bayonet mounting located on a test device 102. The fastening mechanism 146 of the accessory 100 may thus be adapted to cooperate with the device 102 so that no modification of the device 102 is necessary. It is understood that other fastening mechanisms are possible.

In the example illustrated in FIG. 1, the device 102 is a test device configured to determine the identity of vapors and gases or otherwise characterize the vapors and gases (e.g., quantify, etc). In some further embodiments not shown in the accompanying figures, the device may be configured to capture and to analyze particles (e.g., material (e.g., environmental material)), such as particles that can be aerosol borne, such as biological material (e.g., biological threats).

Figure 4:
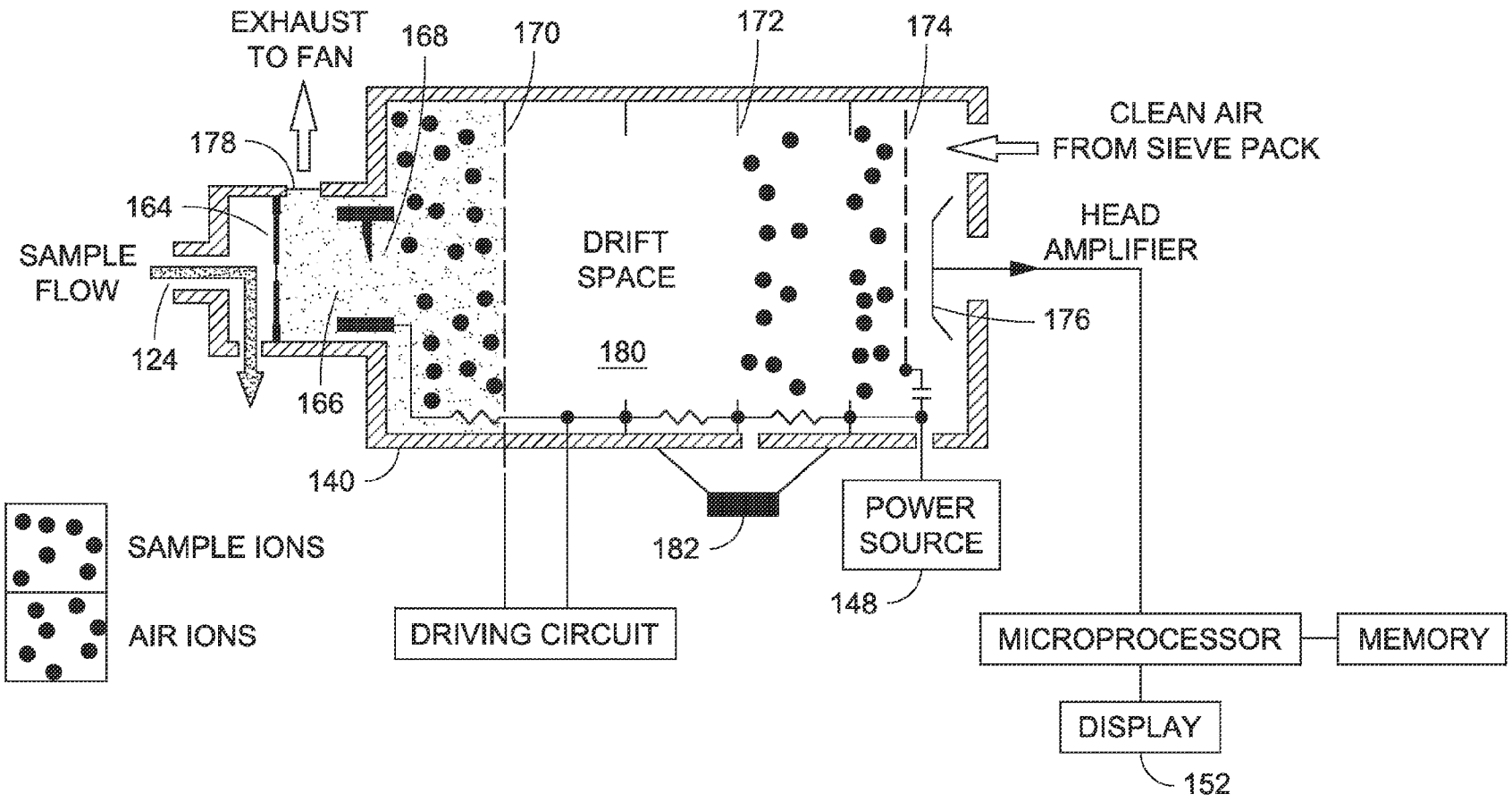
FIG. 4 is a diagrammatic cross-sectional view that illustrates an embodiment of a device in accordance with FIG. 1.

In the example illustrated in FIG. 4, the device 102 is an energy constrained device, and comprises a power source 148 (e.g., batteries, such as rechargeable or non rechargeable batteries). In the example illustrated in FIG. 1, the device 102 is an energy constrained device, and is a particle test device comprising a housing 140 to which the cap is mounted, an audible alarm sounder 150, a display 152, menu keys 154, a sieve pack compartment 156, a battery compartment 158, a top display 160 and an ear piece socket 162, and the on/off switch 106 to be operated by the actuator 104. In the example illustrated in FIGS. 2A and 2B, the switch 106 may comprise a magnetically operated switch such as a reed switch, and the activation mechanism 108 which may be configured to cause a change between an open condition and a closed condition of the magnetically operated switch 106, such as the reed switch. In the example illustrated in FIG. 2A, the activation mechanism 108 comprises a magnet which may be moved by the outer sleeve 120 between the first position of the outer sleeve 120 and the second position of the outer sleeve 120. In other embodiments, the device 102 may have a power source and may be configured not to be power constrained. In the examples illustrated in FIGS. 3A and 3B, the device 102 is powered by the power source 132 which is common to the accessory and the device. The power source 148 may be a non energy constrained power source (such as the battery of the vehicle on which the device is mounted (the device may thus be non energy constrained)) or an energy constrained power source (such as a non rechargeable battery).

In the example illustrated in FIG. 4, the housing 140 includes the inlet 124 for a sample to be analyzed by the device, a pinhole inlet 164, an ionization region 166, a corona discharge ionization source 168, a gating grid 170, electrodes 172 configured to create an electric field, a screen grid 174, a collector 176, an air outlet 178, at least two drift regions 180, the power source 148 (e.g., batteries) and a diaphragm 182.

In the example illustrated in FIG. 4, the device 102 may comprise an Ion Mobility Spectrometer (IMS). An air sample may be drawn into the inlet by an air mover (such as a fan) (not shown). The sample may then pass two pinhole inlets 164, one for each of two ion mobility spectrometers defining each an IMS cell. The diaphragm 182 may be configured to reduce internal pressure in the device 102. The movement of the diaphragm 182 may be under the control of a microprocessor. The sample may be pumped by the diaphragm 182 from the inlet 124 into the spectrometers through the pinhole inlets 164. On passing through the pinhole inlets 164, the sample may enter the ionization region 166 where ions may be generated by the corona discharge ionization source 168. Ions may then be formed from both the air and agent molecules as a result of complex interchange reactions. Typically, the air ions may travel faster than the agent ions. All the ions may be swept towards the gating grid 170 in each IMS cell by the electric field. The gating grid 170 may open momentarily to allow small clusters of ions to enter the two drift regions 180. The two drift regions 180 may operate at different electrical polarities. One drift region may collect ions with a positive charge to identify Nerve Agents, whilst the other may collect ions of a negative charge to identify Blister Agents and/or Blood and/or Choking Agents. The IMS cells may be operated at the same time to give simultaneous nerve and/or blister and/or blood and/or choking detection.

FIG. 1, FIG. 2A, FIG. 2B, FIG. 3A, FIG. 3B and FIG. 4 are illustrations of an example accessory 100 and a device 102 in accordance with some embodiments described herein. Accessories and devices may comprise one or more of the elements depicted in FIG. 1, FIG. 2A, FIG. 2B, FIG. 3A, FIG. 3B and FIG. 4.

In the example illustrated in FIGS. 1, 2A and 2B, the accessory 100 comprises a mechanism (112, 114, 116) configured to cause the cap or a part thereof to move away from the device 102 when the device 102 switches from the off mode to the on mode. Movement of the cap or a part thereof may involve relative rotation or translation with respect to the inner sleeve 122, to cause the cap to allow access to the inlet 124 of the device 102. In the example illustrated in FIG. 2B, the actuator 104 comprises a motorized drive mechanism, e.g., comprising a stepper motor and a control Integrated Circuits (IC). In other embodiments, the actuator 104 may comprise a drive mechanism based on piezoelectric actuators. In the example illustrated in FIGS. 1, 2A and 2B, the mechanism (112, 114, 116) comprises a rotor, a lead screw and a nut, but other mechanisms are possible to cause relative translation of the outer sleeve 120 with respect to the inner sleeve 122, such as, e.g., pistons.

In the example illustrated in FIG. 2A, the activation mechanism 108 comprises a permanent magnet to be used to operate the reed switch 106 of the device. In other embodiments, the activation mechanism 108 may comprise an electro-magnet.

In the examples illustrated in FIG. 3A and FIG. 3B, the controller 110 comprises the receiver 136 configured to receive the control instruction for controlling the operation of the actuator 104 from the remote controller 138. The receiver 136 may be a wireless receiver configured to receive the control instruction wirelessly from the remote controller 138 (see, e.g., FIG. 3A). The receiver 136 may also be a receiver coupled to the remote controller 138 by a wire connection (see, e.g., FIG. 3B). The receiver 136 may be wirelessly coupled to the remote controller 138, a cellular connection, or a radio frequency (RF) connection.

In the examples illustrated in FIG. 3A and FIG. 3B, the remote controller 138 may be configured to be part of at least one of a computer, a network comprising at least two computers, a telecommunications device and a network comprising at least two telecommunications devices. The remote controller 138 may be located in a vehicle, such as land vehicle, a water vehicle and an aircraft, and the device may be mounted on the vehicle, e.g., inside the vehicle or on an external surface of the vehicle.

The device 102 may be another type of device, such as a particle collector device as disclosed in application PCT/US12/71995 entitled "Sealable Particle Collection Device" filed Dec. 28, 2012 or application WO2013/108071 entitled "Sealable Particle Collection Device" filed Dec. 28, 2012, the disclosures of which are herein incorporated by reference.

In operation, in an initial state the device 102 may be in the off mode in which the device consumes less energy than when in the on mode. A user may then operate the remote controller 138 to provide an open instruction to the controller 110 of the accessory 100.

In the examples of FIGS. 3A and 3B, when an open instruction is received by the controller 110, power is provided to the controller 110 by the power source 132. The controller 110 is communicatively coupled with the actuator 104, and the controller 110 then provides a motor drive control signal in the form of a pulsed voltage to the actuator 104.

In the examples of FIG. 3A and FIG. 3B, the controller 110 is configured to activate the actuator 104 to operate the switch 106 when power is applied to the actuator 104. When the actuator 104 is provided with a drive control signal in response to an open instruction, the stepper motor 112 operates the rotor 114 in the tapped nut 116, which causes an upwards movement of the outer sleeve 120 or cap in relation to the inner sleeve 122. The activation mechanism 108 comprising a magnet is carried by the outer sleeve 120, and movement of the magnet activates the reed switch 106 of the device 102. The device is thus in the on mode in which the device is configured to function.

In the examples of FIG. 2A and FIG. 2B, the device 102 is a test device including the housing 140 which defines the opening 130 of the inlet 124 for a sample to be analyzed by the device. When the actuator 104 is provided with a drive control signal in response to an open instruction, the stepper motor 112 operates the rotor 114 in the tapped nut 116, which causes the upwards movement of the outer sleeve 120 or cap in relation to the inner sleeve 122. The actuator 104 may thus be configured to cause the cap to change between the closed and open conditions, which allows access to the inlet 124 of the device 102 through the opening 130 and the aperture 128 for a sample to be analysed, because the peripheral seal 126 is not positioned in front of the aperture 128 anymore. As explained above, the cap is further configured to cause activation of the device 102 in the open condition, which allows the device to run at least one analysis.

The device may be configured to close the cap automatically after a predetermined duration in the on mode, or the user may operate the remote controller 138 to provide a close instruction to the controller 110 of the accessory 100.

In the example of FIG. 3A, when a close instruction is received by the controller 110 from the remote controller 138, power is provided to the controller 110 by the power source 132. The controller 110 is communicatively coupled with the actuator 104, and the controller 110 then provides a motor drive control signal in the form of a pulsed voltage to the actuator 104.

In the example of FIG. 3B, when a close instruction is received by the controller 110, power is no longer supplied to the controller 110 by the power source 132 but is provided by the backup battery 134.

In the examples of FIG. 3A and FIG. 3B, when the actuator 104 is provided with a drive signal in response to a close instruction, operation of the stepper motor 112 rotates the rotor 114 in the tapped nut 116, and causes a downwards movement of the outer sleeve 120 or cap in relation to the inner sleeve 122, and movement of the magnet to deactivate the reed switch 106 of the device 102. The device 102 is thus in the off mode in which the device consumes less energy than when in the on mode.

In the examples of FIG. 2A and FIG. 2B, when the actuator 104 is provided with a drive signal in response to a close instruction, operation of the stepper motor 112 rotates the rotor 114 in the tapped nut 116, which causes the downwards movement of the outer sleeve 120 or cap in relation to the inner sleeve 122. The actuator 104 may thus be configured to cause the cap to change between the open and closed conditions, where the cap may close the opening 130, because the peripheral seal 126 may be positioned in front of the aperture 128.

Figure 5:
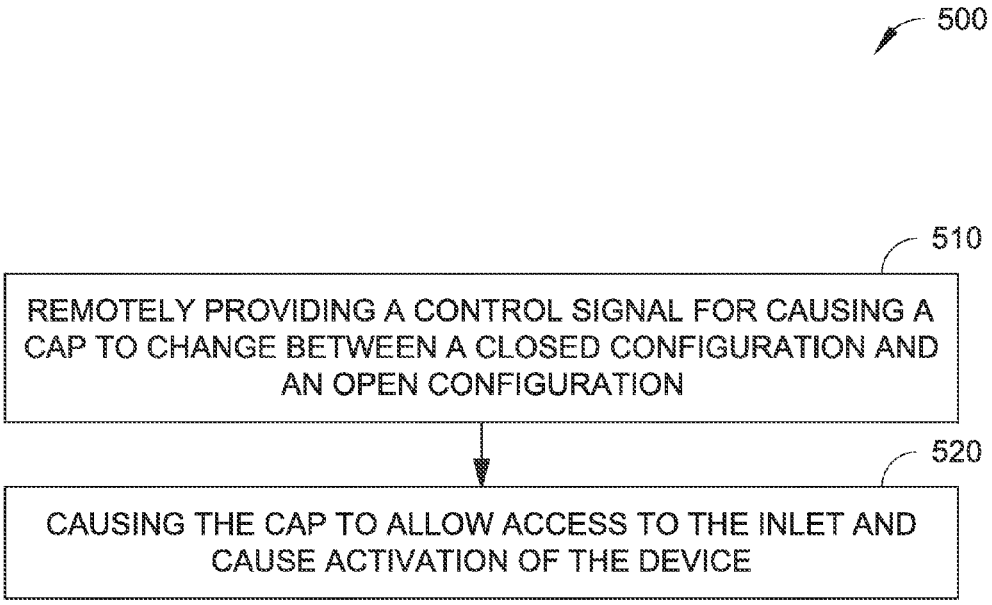
FIG. 5 is a flowchart that illustrates an example method in accordance with the present disclosure.

FIG. 5 illustrates a method in which controlling of a device having an on mode and an off mode may be performed. In the event that the device includes a housing which defines an opening of an inlet for a sample to be analyzed by the device, the method may comprise remotely providing a control signal for causing a cap to change between a closed configuration and an open configuration for causing the cap to allow access to the inlet and cause activation of the device, in order to allow the device to run an analysis.

Aspects of the disclosure provide computer program products, and computer readable media, such as tangible non-transitory media, storing instructions to program a processor to perform any one or more of the methods described herein.

Other variations and modifications of the accessory will be apparent to persons of skill in the art in the context of the present disclosure.

Although the subject matter has been described in language specific to structural features and/or methodological acts, it is to be understood that the subject matter defined in the appended claims is not necessarily limited to the specific features or acts described. Although various configurations are discussed, the apparatus, systems, subsystems, components and so forth can be constructed in a variety of ways without departing from this disclosure. Rather, the specific features and acts are disclosed as example forms of implementing the claims.

What is claimed is:

1. An accessory for a device including a housing which defines an opening of an inlet for a sample to be analyzed by the device, the accessory comprising:

an actuator configured to be activated to operate a switch on the device when the accessory is physically engaged with the device, to cause the device to switch between an off mode and an on mode in which the device is configured to function, the off mode being a mode in which the device consumes less energy than when in the on mode;

a controller communicatively coupled with the actuator, the controller being configured to activate the actuator to operate the switch when power is applied to the actuator; and a cap configured to be mounted to the inlet of the device and having a closed condition where the cap closes the opening of the device and an open condition where the cap allows access to the inlet of the device, the cap including an inner sleeve defining an aperture that allows access to the inlet, the cap including an outer sleeve that allows access to the aperture in the open condition of the cap and forms a peripheral seal that blocks the aperture in the closed condition of the cap, the actuator configured to cause the cap to change between the closed and open conditions.

2. The accessory of claim 1 wherein the controller is further configured to perform at least one of activate the actuator to operate the switch to cause the device to switch to the off mode when power is not applied to the controller and activate the actuator to operate the switch to cause the device to switch to the off mode when power is applied to the controller.

3. The accessory of claim 1 wherein the controller further comprises a receiver configured to receive a control instruction for controlling the operation of the actuator from a remote controller.

4. The accessory of claim 1 further comprising a power source selected from the group consisting of: a non energy constrained power source; an energy constrained rechargeable power source; an energy constrained non-rechargeable power source; a power source configured to further provide power to the device; a power source configured to be independent from a power source of the device; a combination thereof.

5. The accessory of claim 1 further configured to form a protective cap to protect the device from an environment of the device.

6. The accessory of claim 1 further comprising a fastener configured to be mounted on an existing device without modification of the device.

7. The accessory of claim 1 wherein the actuator is further configured to operate without being electrically coupled with the device.

8. The accessory of claim 1 further comprising a mechanism comprising a magnet configured to cause a change between an open condition and a closed condition of a magnetically operated switch of the device.

9. The accessory of claim 1 further comprising a mechanical actuator configured to cause an element of the accessory to move away from the device when the device switches from the off mode to the on mode.

10. A system comprising:

a sample analyzer device having an on mode in which the device is configured to function and an off mode and including a housing which defines an opening of an inlet for a sample to be analyzed by the sample analyzer device; and an accessory for controlling the sample analyzer device, comprising:

a cap configured to be mounted to the inlet of the sample analyzer device and having a closed condition where the cap closes the opening of the sample analyzer device and an open condition where the cap allows access to the inlet of the sample analyzer device, the cap including an inner sleeve defining an aperture that allows access to the inlet, the cap including an outer sleeve that allows access to the aperture in the open condition of the cap and forms a peripheral seal that blocks the aperture in the closed condition of the cap; and an actuator configured to cause the cap to change between the closed and open conditions, the actuator configured to be activated to operate a switch on the sample analyzer device to cause the sample analyzer device to switch between the off mode and the on mode, the off mode being a mode in which the device consumes less energy than when in the on mode; and a controller communicatively coupled with the actuator, the controller being configured to activate the actuator to operate the switch when power is applied to the actuator;

wherein the cap is further configured to cause activation of the sample analyzer device in the open condition, in order to allow the sample analyzer device to run an analysis.

11. The system of claim 10 wherein the accessory further comprises a power source selected from the group consisting of: a non-energy constrained power source; an energy constrained rechargeable power source; an energy constrained non-rechargeable power source; a power source configured to further provide power to the sample analyzer device; a power source configured to be independent from a power source of the sample analyzer device; a combination thereof; and wherein the sample analyzer device further comprises a power source selected from the group consisting of: a non-energy constrained power source; an energy constrained rechargeable power source; an energy constrained non-rechargeable power source; a power source configured to further provide power to the accessory; a power source configured to be independent from a power source to the accessory; a combination thereof.

12. The system of claim 10 wherein the system is configured to be portable by a user.

13. The system of claim 10 further comprising a mounting bracket configured to enable the mounting of the sample analyzer device on a vehicle comprising at least one of a land vehicle, a water vehicle and an aircraft.

14. The system of claim 10 wherein the accessory comprises a receiver configured to receive a control instruction for controlling the operation of the actuator from a remote controller.

15. The system of claim 14 wherein the receiver is at least one of a wireless receiver configured to receive the control instruction wirelessly from the remote controller and a receiver coupled to the remote controller by a wire connection.

16. The system of claim 14 wherein the receiver is wirelessly coupled to the remote controller via at least one of a cellular connection and a radio frequency connection.

17. The system of claim 14 further comprising the remote controller configured to transmit the control instruction for controlling the operation of the actuator.

18. The system of claim 17 wherein the remote controller is further configured to be part of at least one of a computer, a network comprising at least two computers, a telecommunications device and a network comprising at least two telecommunications devices.

19. The system of claim 10 wherein the sample analyzer device further comprises an activation switch, independent from the cap, to activate the sample analyzer device, and wherein the cap further comprises an actuator configured to cause a change between an open condition and a closed condition of the activation switch of the sample analyzer device.

20. A method for controlling a device having an on mode in which the device is configured to function and an off mode in which the device consumes less energy than when in the on mode and including a housing which defines an opening of an inlet for a sample to be analyzed by the device, the method comprising:

remotely providing a control instruction to a controller communicatively coupled with an actuator, the controller being configured to activate the actuator to operate a switch on the device when power is applied to the actuator, the actuator configured to be activated to operate the switch to cause the device to switch between the off mode and the on mode, the actuator for causing a cap mounted to the inlet of the device to change between a closed configuration where the cap closes the opening of the device and an open configuration where the cap allows access to the inlet of the device, the control instruction for causing the cap to allow access to the inlet and cause activation of the device in order to allow the device to run an analysis, wherein the cap includes an inner sleeve defining an aperture that allows access to the inlet, and the cap includes an outer sleeve that allows access to the aperture in the open configuration of the cap and forms a peripheral seal that blocks the aperture in the closed configuration of the cap.

* * * * *